US005172802A

United States Patent [19]

Wells

[11] Patent Number: 5,172,802

[45] Date of Patent: Dec. 22, 1992

[54] SELECTIVE RELEASE ASSEMBLY FOR GRIPPER CLAMPS

[75] Inventor: Dale K. Wells, Englewood, Ohio

[73] Assignee: AM International Inc., Chicago, Ill.

[21] Appl. No.: 760,955

[22] Filed: Sep. 17, 1991

[51] Int. Cl.[5] ..... B65G 47/86

[52] U.S. Cl. ..... 198/470.1; 198/803.7; 198/477.1

[58] Field of Search ..... 198/470.1, 477.1, 476.1, 198/803.7, 803.8, 803.9

[56] References Cited

U.S. PATENT DOCUMENTS

| | | | |
|---|---|---|---|
| 3,122,362 | 2/1964 | Vollrath et al. | 198/803.7 X |
| 3,204,756 | 9/1965 | Lesch | 198/803.7 X |
| 3,430,750 | 3/1969 | Saules | 198/470.1 |
| 4,307,801 | 12/1981 | Hänsch | 198/803.7 X |
| 4,320,894 | 3/1982 | Reist et al. . | |
| 4,381,056 | 4/1983 | Eberle | 198/803.7 |
| 4,382,422 | 5/1983 | Eddy et al. | 198/470.1 X |
| 4,638,906 | 1/1987 | Winiasz . | |
| 4,681,213 | 7/1987 | Winiasz . | |
| 4,921,294 | 5/1990 | Klopfenstein . | |

*Primary Examiner*—D. Glenn Dayoan
*Attorney, Agent, or Firm*—Tarolli, Sundheim & Covell

[57] ABSTRACT

A release assembly is mounted adjacent a track to release selected ones of a plurality of gripper clamps movable along the track past the release assembly. The release assembly includes a cam mounted for movement relative to the track between a first position in which the cam is engageable by a gripper clamp moving along the track, to open the gripper clamp, and a second position in which the cam is spaced from and not engageable by the moving gripper clamp. The release assembly includes a rotary actuator selectively operable to move the cam between its first and second positions. The release assembly includes an overcenter linkage for blocking movement of the cam out of its first position toward its second position upon engagement by a moving gripper clamp.

16 Claims, 5 Drawing Sheets

SELECTIVE RELEASE ASSEMBLY FOR GRIPPER CLAMPS

BACKGROUND OF THE INVENTION

The present invention relates to a selective release assembly for gripper clamps. Gripper clamps are commonly used in conveyor assemblies of sheet material handling apparatus to convey sheet material articles, such as newspapers or magazines, from one location to another. U.S. Pat. No. 4,638,906 shows a conveyor assembly which includes a plurality of gripper clamps connected by a conveyor chain and movable along a track. Some examples of known gripper clamps are shown in U.S. Pat. Nos. 4,681,213; 4,320,894; and 4,921,294.

Some gripper clamps are spring biased into a closed or clamping position for holding sheet material such as a book. It is desirable to be able to open selected gripper clamps moving past a particular point on a conveyor assembly, in order to release the sheet material articles held in the selected gripper clamps.

SUMMARY OF THE INVENTION

The present invention is a release assembly for mounting adjacent a track and for releasing selected ones of a plurality of gripper clamps movable along the track past the release assembly. The release assembly includes a cam mounted for movement relative to the track between a first position in which the cam is engageable by a gripper clamp moving along the track to open the gripper clamp, and a second position in which the cam is spaced from and not engageable by the moving gripper clamp. The release assembly includes an actuator selectively operable to move the cam between its first and second positions. In a preferred embodiment. the actuator is a rotary actuator, and the release assembly includes an overcenter linkage for blocking movement of the cam out of its first position toward its second position upon engagement by a moving gripper clamp.

BRIEF DESCRIPTION OF THE DRAWINGS

The foregoing and other features of the present invention will become apparent to one skilled in the art upon a consideration of the following description of the invention with reference to the accompanying drawings, wherein.

DESCRIPTION OF PREFERRED EMBODIMENTS

The present invention relates to a release assembly for selectively releasing gripper clamps moving along a conveyor track. The present invention is applicable to various gripper clamp release assembly constructions and can be used in conjunction with gripper clamps or conveyor tracks of varying construction.

Figure 1:
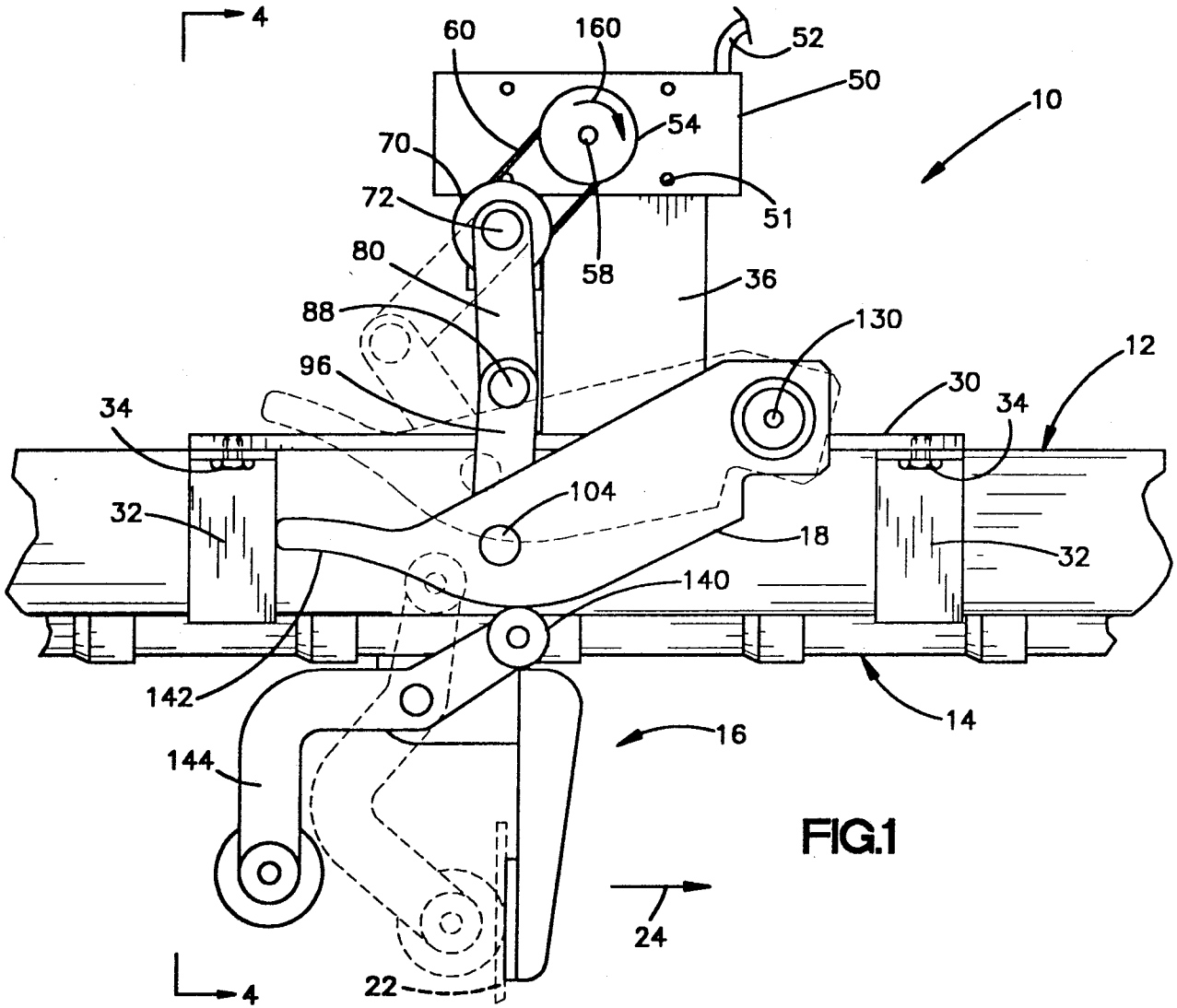
FIG. 1 is a front elevational view of a release assembly in accordance with the present invention, illustrated in solid lines in a first or release position and in dashed lines in a second or bypass position.
Figure 2:
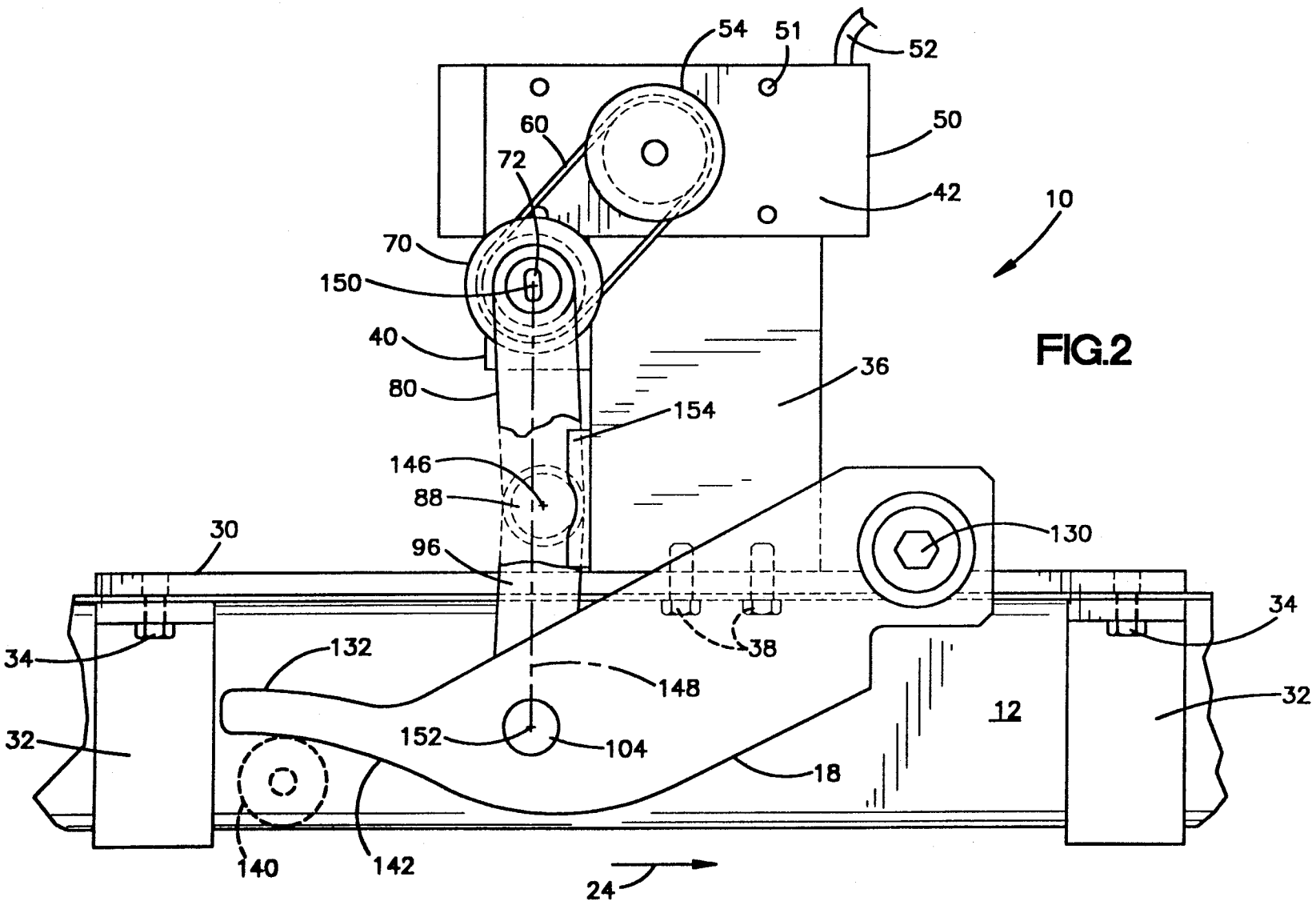
FIG. 2 is an enlarged front elevational view of the release assembly of FIG. 2 illustrating the cam in its first position.

As representative of the present invention, FIG. 1 illustrates a selective release assembly 10. The release assembly 10 is mounted adjacent a conveyor track 12 along which a moving chain 14 carries a plurality of gripper clamps 16, only one of which is shown. The track 12, the chain 14, and the gripper clamps 16 may be of a known construction.

Figure 3:
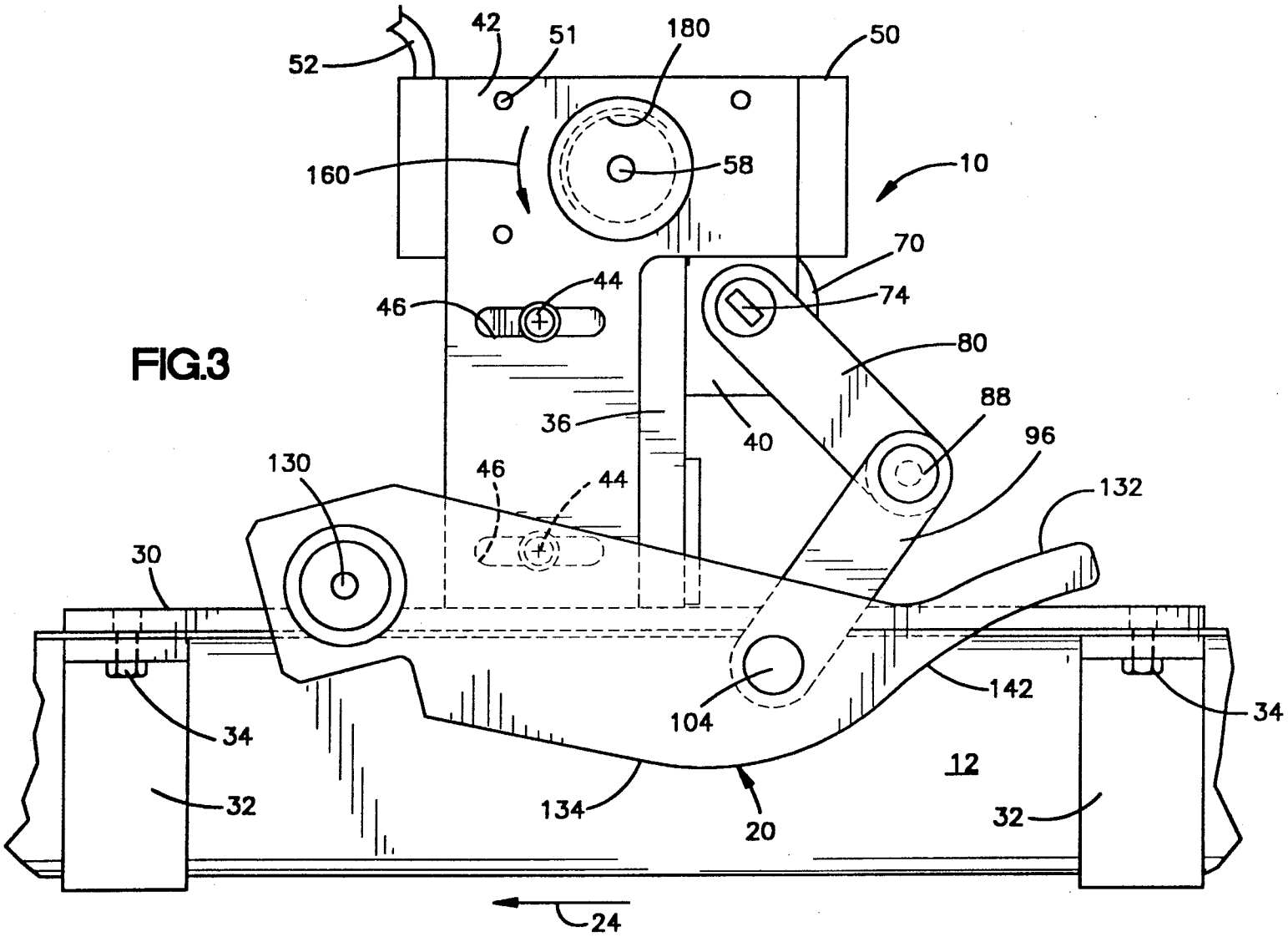
FIG. 3 is a rear elevational view of the release assembly of FIG. 1.

The release assembly 10 includes a pair of cams 18 (FIGS. 1, 2, 4 and 8) and 20 (FIGS. 3 and 4) which are positionable in the path of movement of the gripper clamps 16. When a moving gripper clamp 16 engages the cams 18 and 20, the cams 18 and 20 open the gripper clamp 16 from a clamping condition as shown in solid lines in FIG. 1 to a release condition as shown in dashed lines in FIG. 1, to release a book 22 or other article being carried by the gripper clamp 16. The release assembly 10 is selectively operable, in a manner described below, to move the cams 18 and 20 into and out of the path of movement of a gripper clamp 16, depending on whether a particular book 22 is to be released.

It should be understood that a release assembly in accordance with the present invention may include only one cam, disposed over either the front or rear of the track 12, to engage and open a gripper clamp 16. In the illustrated embodiment, in which the two cams 18 and 20 are used, the parts of the release assembly 10 which operate the cam 18 are similar to the parts of the assembly 10 which operate the cam 20. Accordingly, only one set of such parts will be described herein, usually with reference to the cam 18. Where similar parts are shown, they are given identical reference numerals.

Figure 4:
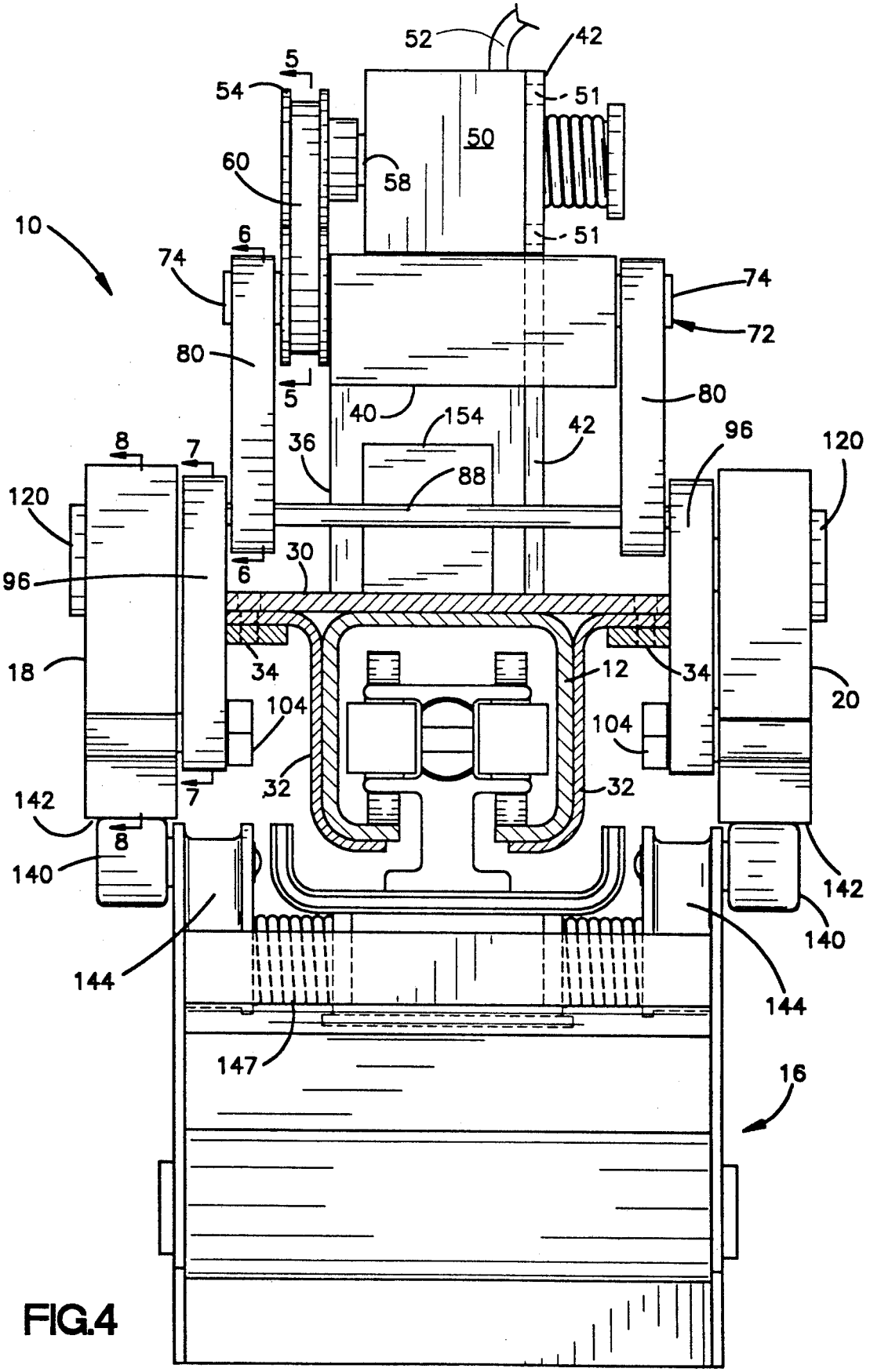
FIG. 4 is a sectional view taken along line 4—4 of FIG. 1.

The track 12 along which the gripper clamps 16 move is C-shaped, as is best seen in FIG. 4. A mounting plate 30 is fixed to the top of the track 12 by clamps 32 and fasteners 34 at each end of the mounting plate 30. A mounting block 36 is fixed to the mounting plate 30 by fasteners 38. The mounting block 36 projects upwardly from the mounting plate 30. A shaft support block 40 is fixed to the mounting block 36 and projects from the block 36 in a direction toward the left as viewed in FIG. 2.

An actuator support plate 42 is attached to the mounting block 36 by a pair of screws 44 (FIG. 3) and extends upwardly of the mounting block 36. An actuator 50 is attached to the actuator support plate 42 by fasteners 51. The actuator 50 is preferably a fluid operated rotary actuator supplied with fluid under pressure through a fluid supply line 52. A suitable actuator is a rotary actuator Model No. 0180-75-2 available from PHD, Inc. of Fort Wayne, Ind.

Figure 5:
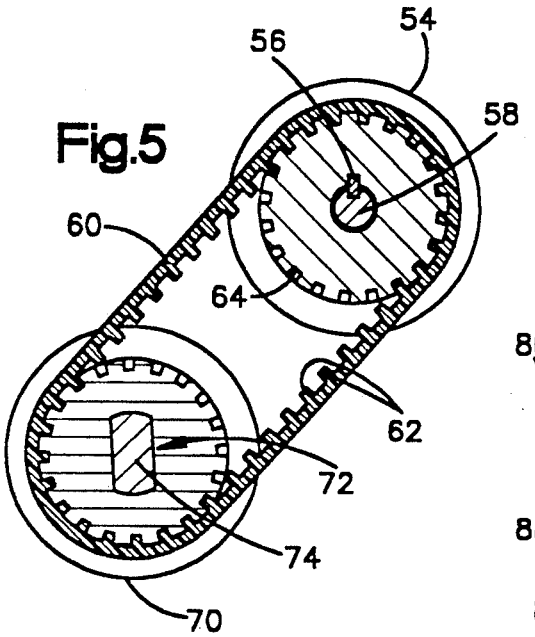
FIG. 5 is a sectional view taken along line 5—5 of FIG. 4.

A drive pulley 54 (FIGS. 4 and 5) is fixed by a Woodruff key 56 to an output shaft 58 of the actuator 50. An internally toothed drive belt 60 extends around the pulley 54. The drive belt 60 has a plurality of teeth 62 extending transversely to the direction of movement of the belt 60. The drive pulley 54 has a plurality of external grooves 64 which receive the teeth 62 of the drive belt 60.

The drive belt 60 also extends around a second externally grooved pulley 70 fixed on an actuating shaft 72. The end portion 74 of the actuating shaft 72 has a double-D configuration to block rotation of the pulley 70 on the actuating shaft 72. The actuating shaft 72 is mounted for rotation in the shaft support block 40.

The tension on the drive belt 60 between the pulleys 54 and 70 is adjustable. The screws 44 (FIG. 3), which attach the actuator support plate 42 to the mounting block 36, extend through slots 46 in the actuator support plate 42. Upon loosening of the screws 44, the actuator support plate 42 and the actuator 50 can be moved longitudinally (to the left or right as viewed in FIG. 3) relative to the shaft support block 40, to vary the tension on the drive belt 60.

Figure 6:
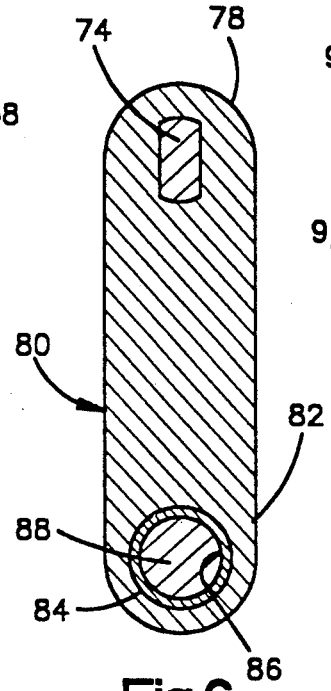
FIG. 6 is a sectional view taken along line 6—6 of FIG. 4.

Also fixed on the end portion 74 of the actuating shaft 72, axially outwardly of the pulley 70, is an upper end portion 78 of an actuating arm 80 (FIGS. 4 and 6). In a lower end portion 82 of the actuating arm 80 a bushing 84 defines an opening 86.

Figure 7:
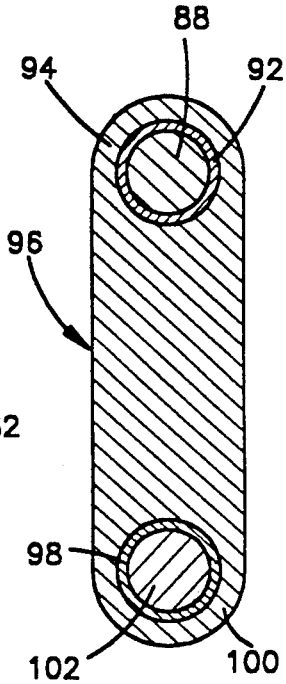
FIG. 7 is a sectional view taken along line 7—7 of FIG. 4.
Figure 8:
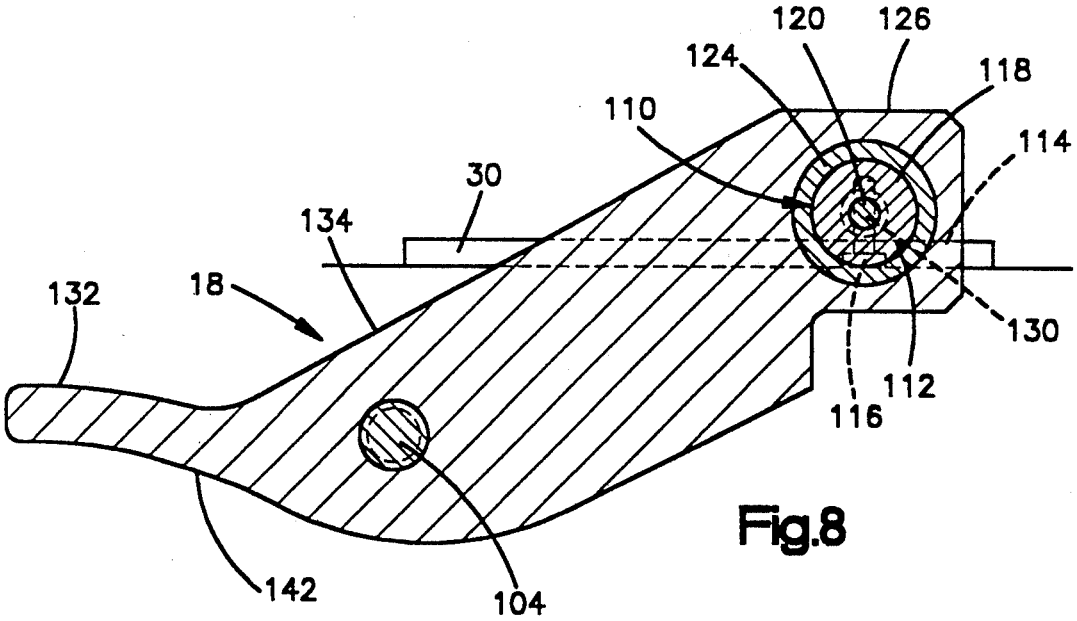
FIG. 8 is a sectional view taken along line 8—8 of FIG. 4.

A linkage shaft 88 is rotatably received in the opening 86 in the bushing 84. The linkage shaft 88 also extends through a bushing 92 in an upper end portion 94 of a linkage arm 96 (FIGS. 4 and 7). The linkage shaft 88 is rotatable in the bushing 92. Another bushing 98 is located in a lower end portion 100 of the linkage arm 96.

A shaft portion 102 of a shoulder bolt 104 extends through the bushing 98. The shoulder bolt 104 is rotatable relative to the linkage arm 96. The shoulder bolt 104 is fixedly threaded into the cam 18 (FIGS. 1 and 4).

The cam 18 is mounted for pivotal movement about a shaft 110 fixed to the mounting plate 30. The shaft 110 (seen in end view in FIG. 8) has a flat bottom surface 112 engaging a flat upper surface 114 of the plate 30. The shaft 110 is fixed to the mounting plate 30 by fasteners 116 extending upwardly from the mounting plate 30. The shaft 110 has a circular end portion 118. A bushing 124 in a first end portion 126 of the cam 18 is rotatable about the end portion 118 of the shaft 110. A bolt 120 threaded into the end portion 118 of the shaft 110 blocks axial movement of the cam 18 relative to the shaft 110. The cam 18 is thus mounted for pivotal movement relative to the track 12, about an axis 130 extending through the bolts 120 and the shaft 110.

A second end portion 132 of the cam 18, opposite from the first end portion 126, has a cam surface 142 for engagement by the gripper clamp 16. Intermediate the first end portion 126 and the second end portion 132 is a central portion 134 of the cam 18. The shoulder bolt 104 is threaded into the central portion 134.

To release a selected book 22 (FIG. 1) being carried by a moving gripper clamp 16, the cam 18 is maintained in its first position shown in solid lines in FIG. 1. The actuator 50 is not energized. A wheel 140 on the moving gripper clamp 16 engages the cam surface 142 on the cam 18. The cam surface 142 forces the wheel 140 downward, pivoting an arm 144 of the gripper clamp 16 against the bias of a spring 147. The gripper clamp 16 opens, and the gripper clamp 16 releases the book 22.

The gripper clamp 16 can in some cases engage the cam 18 with a substantial amount of force. To ensure that the book 22 is released, it is necessary to maintain the cam 18 in its first position upon engagement by the moving gripper clamp 16. It is preferred not to use the actuator 50 to accomplish this task, for two reasons: the actuator 50 would need to be constantly energized, and it would have to absorb the force of the moving gripper clamp 16 as transmitted to the cam 18.

Accordingly, the present invention provides an overcenter linkage means for blocking movement of the cam 18 out of its first position and also for absorbing the force of the moving gripper clamp 16 as transmitted to the cam 18. As can best be seen in FIG. 2, the actuating arm 80 and the linkage arm 96 are not aligned parallel to each other when the cam 18 is in its first position. Rather, the central axis 146 of the linkage shaft 88 lies on the downstream side (to the right as viewed in FIG. 2) of an imaginary line 148 extending between the central axis 150 of the actuating shaft 72 and the central axis 152 of the shoulder bolt 104. This arrangement of the actuating arm 80 and the linkage arm 96 is referred to herein as an overcenter condition. In this overcenter condition, the linkage shaft 88 is in abutting engagement with a shock absorbing pad 154 fixed to the mounting block 36. The shock absorbing pad 154 is made of rubber or another suitable material.

When a wheel 140 (as shown in phantom in FIG. 2) of a moving gripper clamp 16 engages the cam 18, the force of the moving gripper clamp 16 is transmitted into the cam 18 and through the shoulder bolt 104 into the linkage arm 96. Because of the overcenter positioning of the actuating arm 80 and the linkage arm 96, the force acting on the linkage arm 96 urges the linkage shaft 88 in a direction to the right as viewed in FIG. 2 The linkage shaft 88 engages the shock absorbing pad 154, and transmits the force of its movement through the shock absorbing pad 154 to the mounting block 36. The force of the moving gripper clamp 16 is thus transmitted into the solid structure of the release assembly 10 rather than up through the actuator linkage to the actuator 50. The cam 18 is maintained in its first position as desired, without the need to energize the actuator 50.

When a selected book 22 being carried by a moving gripper clamp 16 is not to be released, the cam 18 is moved to its bypass position as shown in dashed lines in FIG. 1, just before the moving gripper clamp 16 reaches the release assembly 10. To move the cam 18, the actuator 50 is energized by supplying fluid under pressure through the supply line 52 to the actuator 50. The actuator 50 rotates the actuator output shaft 58 and the pulley 54 in a direction as indicated by the arrow 160 in FIG. 1. Upon rotation of the pulley 54, the drive belt 60 causes the pulley 70 to rotate. Rotation of the pulley 70 results in rotation of the actuating shaft 72.

Rotation of the actuating shaft 72 pivots the actuator arm 80, thereby swinging the linkage shaft 88 in an arc about the center of the actuating shaft 72. The orbiting movement of the linkage shaft 88 is transmitted through the linkage arm 96 to lift the shoulder bolt 104. Since the cam 18 is fixed to the shoulder bolt 104, the cam 18 is also lifted, pivoting about its axis 130. The cam 18 is lifted into its second (bypass) position as shown in dashed lines in FIG. 1. In this position, the cam 18 is raised high enough so that is not engageable by (in the path of) the moving gripper clamp 16. The gripper clamp 16 moves along the track 12 past the release assembly 10, without releasing the book 22.

To return the cam 18 from its second position to its first position, fluid pressure on the actuator 50 is released. A return spring 180 (FIG. 3) connected with the actuator output shaft 58 rotates the actuator output shaft in the opposite direction from the arrow 160 and acts through the drive belt 60, the actuating arm 80, and the linkage arm 96 to lower the cam 18 into its first position.

From the above description of the invention, those skilled in the art will perceive improvements, changes and modifications in the invention. Such improvements, changes and modifications within the skill of the art are intended to be covered by the appended claims.

I claim:

1. A release assembly for mounting adjacent a track and for releasing selected ones of a plurality of gripper clamps movable along the track past said release assembly, said release assembly comprising:

a cam mounted for movement relative to the track between a first position in which said cam is engageable by a gripper clamp moving along the track to open the gripper clamp and a second position in which said cam is spaced from and not engageable by the moving gripper clamp;

a rotary actuator having an output shaft rotatable about its axis, said rotary actuator being selectively energizeable to initiate rotation of said output shaft of said rotary actuator; and a linkage actuated by rotation of said output shaft for moving said cam between its first and second positions.

2. A release assembly as set forth in claim 1 wherein said linkage includes a drive belt for transmitting force from said output shaft to an actuating arm connected with said cam.

3. A release assembly as set forth in claim 1 wherein the plurality of gripper clamps are moved by conveyor drive means along the track past said release assembly, said release assembly including means separate from the conveyor drive means for energizing said rotary actuator.

4. A release assembly as set forth in claim 1 including means for maintaining said cam in said first position, said rotary actuator being selectively energizable to initiate rotation of said output shaft of said rotary actuator in a first direction through a predetermined arc of rotation to move said cam from its first position to its second position.

5. A release assembly as set forth in claim 4 wherein said means for normally maintaining said cam in said first position comprises a return spring for rotating said output shaft of said rotary actuator in a second direction opposite to the first direction to return said cam to said first position from its second position.

6. A release assembly for mounting adjacent a track and for releasing selected ones of a plurality of gripper clamps movable along the track past said release assembly, said release assembly comprising:

a cam mounted for pivotal movement relative to the track between a first position in which said cam is engageable by a gripper clamp moving along the track to open the gripper clamp and a second position in which said cam is spaced from and not engageable by the moving gripper clamp;

a rotary actuator selectively energizable to move said cam between its first and second positions; and linkage means for connecting said rotary actuator with said cam and for transmitting force from said rotary actuator to said cam to move said cam between its first and second positions;

said linkage means comprising means for converting rotary movement of said actuator to pivotal movement of said cam;

said linkage means comprising an overcenter linkage for blocking movement of said cam out of its first position toward its second position upon engagement by a moving gripper clamp.

7. A release assembly as set forth in claim 6 wherein said linkage means comprises a drive belt connected with and extending from said rotary actuator, a first linkage arm driven by said drive belt, and a second linkage arm pivotally interconnecting said first linkage arm and said cam.

8. A release assembly as set forth in claim 7 wherein said overcenter linkage means comprises a movable member movable with said first and second linkage arms and a blocking member fixedly connected with the track to block movement of said movable member and thereby limit pivotal movement of said cam out of its first position toward its second position.

9. A release assembly as set forth in claim 7 wherein said cam has first and second end portions, said first end portion being pivotally mounted to the track, said second end portion having a cam surface for engagement by a moving gripper clamp, said linkage means being connected with a central portion of said cam intermediate said first and second end portions.

10. A release assembly for mounting adjacent a track and for releasing selected ones of a plurality of gripper clamps movable along the track past said release assembly, said release assembly comprising:

a cam mounted for movement relative to the track between a first position in which said cam is engageable by a gripper clamp moving along the track to open the gripper clamp and a second position in which said cam is spaced from and not engageable by the moving gripper clamp;

an actuator selectively energizable to move said cam between its first and second positions; and overcenter linkage means for connecting said actuator with said cam and for blocking movement of said cam out of its first position toward its second position upon engagement by a moving gripper clamp.

11. A release assembly as set forth in claim 10 wherein said linkage means comprises first and second linkage arms interconnected for pivotal movement relative to each other, said first linkage arm being connected with said actuator, said second linkage arm being connected with said cam.

12. A release assembly as set forth in claim 11 wherein said linkage means comprises a movable member interconnecting said first and second linkage arms and a blocking member for blocking movement of said movable member to thereby limit movement of said cam out of its first position toward its second position.

13. A release assembly as set forth in claim 11 wherein said actuator is a rotary actuator.

14. A release assembly as set forth in claim 13 wherein said cam is mounted for pivotal movement relative to the track and said linkage means comprises means for converting rotary movement of said actuator to pivotal movement of said cam.

15. A release assembly as set forth in claim 11 including spring means for normally maintaining said cam in said first position, said actuator being selectively energizable to move said cam from its first position to its second position.

16. A release assembly as set forth in claim 11 wherein said cam has a first end portion pivotally connected with the track, a second end portion for engagement by a moving gripper clamp, and a third portion intermediate said first and second end portions and connected with said second linkage arm for receiving actuation force from said actuator.

* * * * *